US006968953B2

(12) United States Patent
Humphrey

(10) Patent No.: US 6,968,953 B2
(45) Date of Patent: Nov. 29, 2005

(54) CEILING FAN MOTOR PACKAGING AND METHOD

(75) Inventor: Neall W. Humphrey, El Dorado Hills, CA (US)

(73) Assignee: Craftmade International, Inc., Coppell, TX (US)

( * ) Notice: Subject to any disclaimer, the term of this patent is extended or adjusted under 35 U.S.C. 154(b) by 80 days.

(21) Appl. No.: 10/356,275

(22) Filed: Jan. 31, 2003

(65) Prior Publication Data

US 2004/0149604 A1 Aug. 5, 2004

(51) Int. Cl.[7] ..... B65D 77/00
(52) U.S. Cl. ..... 206/576; 206/320; 206/471
(58) Field of Search ..... 206/320, 576, 206/577, 591, 594, 467, 471

(56) References Cited

U.S. PATENT DOCUMENTS 4,828,115 A * 5/1989 Wiegand et al. ..... 206/576
5,064,056 A * 11/1991 Gresh ..... 206/321
5,292,003 A * 3/1994 Baghdassarian ..... 206/575
D394,384 S 5/1998 Humphrey
5,779,045 A * 7/1998 Yu ..... 206/320
D405,370 S 2/1999 Humphrey
5,890,593 A 4/1999 Humphrey
D414,108 S 9/1999 Humphrey
5,947,291 A 9/1999 Humphrey
D416,485 S 11/1999 Humphrey
D418,408 S 1/2000 Humphrey
D419,065 S 1/2000 Humphrey
D426,462 S 6/2000 Humphrey
D429,149 S 8/2000 Humphrey
D430,019 S 8/2000 Humphrey
D433,324 S 11/2000 Humphrey
D433,325 S 11/2000 Humphrey
D433,626 S 11/2000 Humphrey
D433,939 S 11/2000 Humphrey
D434,317 S 11/2000 Humphrey
D434,650 S 12/2000 Humphrey
D435,214 S 12/2000 Humphrey
D436,858 S 1/2001 Humphrey
D438,102 S 2/2001 Humphrey
D439,836 S 4/2001 Humphrey
D441,647 S 5/2001 Humphrey
D442,479 S 5/2001 Humphrey
D442,480 S 5/2001 Humphrey
D442,481 S 5/2001 Humphrey
D442,482 S 5/2001 Humphrey
D442,858 S 5/2001 Humphrey
D444,057 S 6/2001 Humphrey
D445,025 S 7/2001 Humphrey
D446,714 S 8/2001 Humphrey
D446,715 S 8/2001 Humphrey
D446,716 S 8/2001 Humphrey
D447,050 S 8/2001 Humphrey
D447,051 S 8/2001 Humphrey
D447,407 S 9/2001 Humphrey
D447,408 S 9/2001 Humphrey
D447,409 S 9/2001 Humphrey
D447,939 S 9/2001 Humphrey
D449,225 S 10/2001 Humphrey
D449,519 S 10/2001 Humphrey
D451,383 S 12/2001 Humphrey
6,325,209 B1 12/2001 Humphrey
D452,651 S 1/2002 Humphrey (Continued)

*Primary Examiner*—Jacob K. Ackun, Jr.
(74) *Attorney, Agent, or Firm*—Haynes and Boone, LLP

(57) ABSTRACT

A ceiling fan motor packaging is described, which allows for marketing various components of a ceiling fan separately.

8 Claims, 9 Drawing Sheets

U.S. PATENT DOCUMENTS

| | | | |
|---|---|---|---|
| D454,490 | S | 3/2002 | Humphrey |
| D454,491 | S | 3/2002 | Humphrey |
| D455,346 | S | 4/2002 | Humphrey |
| D455,650 | S | 4/2002 | Humphrey |
| D456,250 | S | 4/2002 | Humphrey |
| D458,126 | S | 6/2002 | Humphrey |
| D459,224 | S | 6/2002 | Humphrey |
| 6,419,085 | B1 | 7/2002 | Humphrey |
| 6,422,390 | B1 | 7/2002 | Humphrey |
| D462,265 | S | 9/2002 | Humphrey |
| D465,413 | S | 11/2002 | Humphrey |
| D466,009 | S | 11/2002 | Humphrey |
| D470,410 | S | 2/2003 | Humphrey |
| 6,536,655 | B1 | 3/2003 | Humphrey |
| D473,135 | S | 4/2003 | Humphrey |
| D474,400 | S | 5/2003 | Humphrey |
| D479,463 | S | 9/2003 | Humphrey |
| D479,990 | S | 9/2003 | Humphrey |
| D480,637 | S | 10/2003 | Humphrey |
| D481,311 | S | 10/2003 | Humphrey |
| D482,273 | S | 11/2003 | Humphrey |

* cited by examiner

CEILING FAN MOTOR PACKAGING AND METHOD

BACKGROUND

The present disclosure relates generally to ceiling fan motor packaging which allows for marketing various components of a ceiling fan separately.

In the past, ceiling fans were sold as complete units, that is, as a single ceiling fan with the motor, blade irons, and blades included. However, aesthetics are an important factor in ceiling fan selection, and thus providing a greater variety of aesthetic options is, understandably, an important goal.

Therefore, what is needed is a ceiling fan packaging which allows for marketing various components of a ceiling fan separately.

DESCRIPTION

Figure 1:
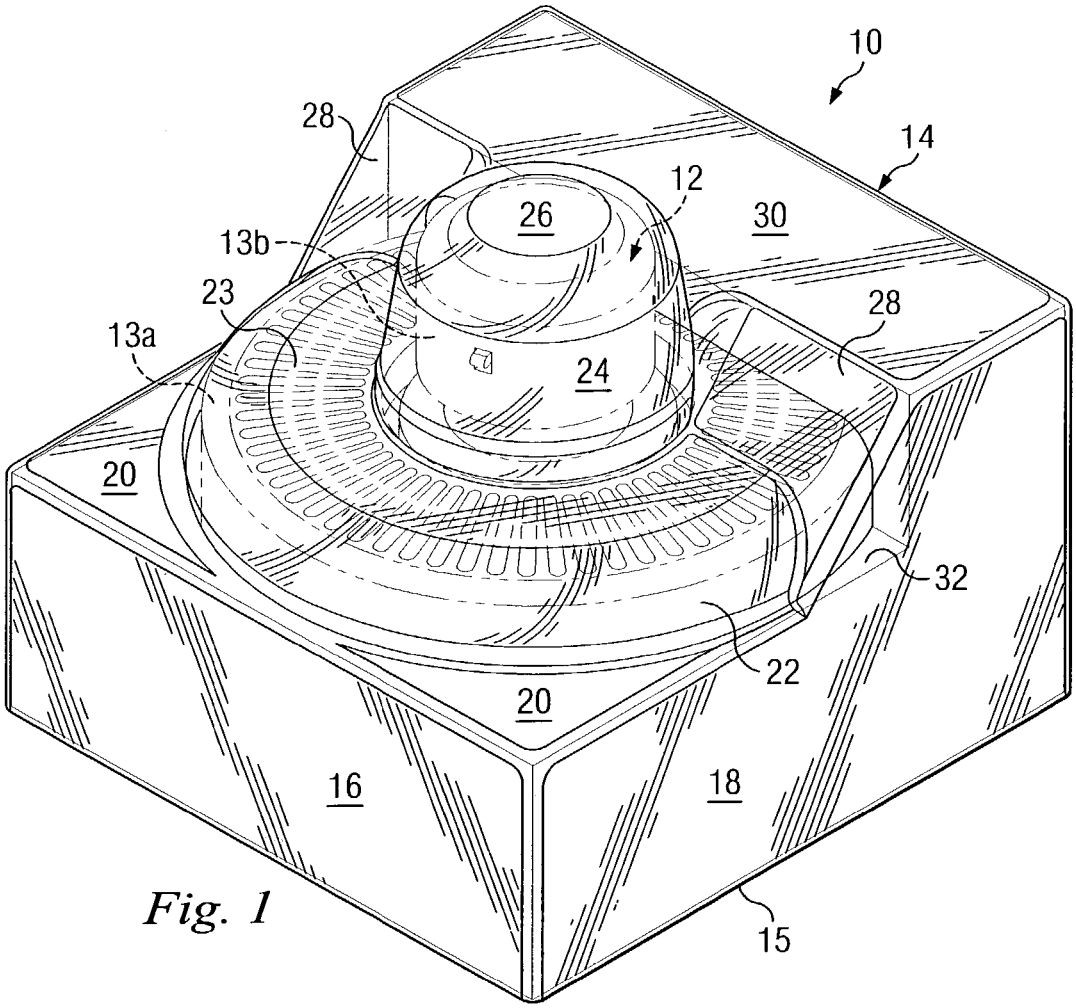
FIG. 1 is a top perspective view of a ceiling fan motor packaging according to one embodiment of the present disclosure.

Referring to FIG. 1, a ceiling fan motor packaging 10 is illustrated. The packaging 10 allows a ceiling fan motor 12 to be packaged and sold separately from the associated blade irons, such as will be discussed with reference to FIGS. 3A–C, and associated ceiling fan blades, such as will be discussed with reference to FIGS. 4A–C. It is understood that the ceiling fan motor 12 is illustrated in phantom to indicate the important potential for aesthetic variation among ceiling fan motors. The ceiling fan motor 12 has a motor housing 13*a* and a directional switch and speed switch housing 13*b*.

The packaging 10 comprises a shell 14, at least a portion of which is transparent for reasons to be described. In a preferred embodiment, the shell 14 is heat molded or formed as a conventional blister package. In one embodiment, the blister is formed from a transparent plastic. It is understood that the method of producing a blister package is well known to those in the packaging art.

As viewed in FIG. 1, it can be appreciated that the packaging 10 is resting on a back 15. In one embodiment, the back 15 is not covered by the shell 14.

The shell 14 comprises a series of surfaces. A surface 16 forms the top of the packaging 10. The packaging 10 also has a bottom 17 which has a greater area than the top 16. Thus, the bottom 17 allows the packaging 10 to be freestanding. A freestanding packaging is a significant achievement, as ceiling fan motors are generally spherical, with protruding housings (i.e., the housing 13*a* and the housing 13*b*) and connecting rods (not depicted). It can be appreciated that a freestanding packaging aids commercial display of the ceiling fan motor.

A surface 18 forms one side of the packaging 10, and it is understood that the packaging has a second side (not depicted) which is essentially the mirror image of the surface 18.

Figure 2:
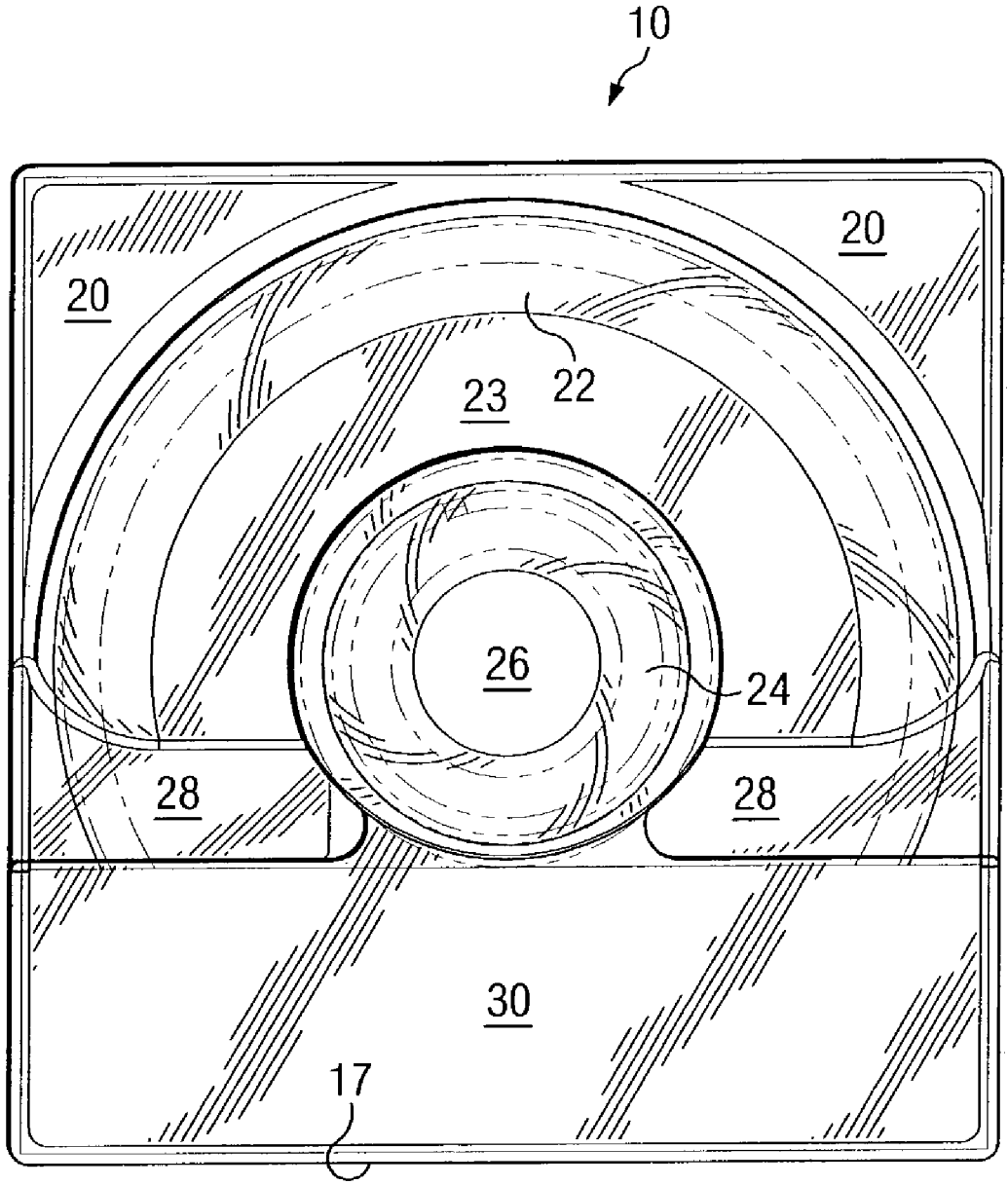
FIG. 2 is a front view of the ceiling fan motor packaging of FIG. 1.

Referring now to FIGS. 1 and 2, surfaces 20–30 cooperate to define the front of the packaging 10. The surface 20 is a planar surface disposed adjacent to the surfaces 16 and 18. A curved surface 22 rises from the surface 20, in a shape corresponding to that of the motor housing 13*a* of the ceiling fan motor 12, and terminating in a planar surface 23.

In turn, a curved surface 24 rises from the surface 23, in a shape corresponding to that of the directional switch and speed switch housing 13*b* of the ceiling fan motor 12. A planar surface 26 represents the apex of the surface 24.

An inclined surface 28 slopes up and away from the surfaces 20 and 22, and culminates in a planar surface 30. The surface 30 is adjacent to the bottom (not depicted) of the packaging 10.

It can be appreciated that the shell 14 provides a protective layer over the ceiling fan motor 12, thus preventing damage to the ceiling fan motor, as well as preventing tampering with the ceiling fan motor. At the same time, the shell 14 provides an opportunity for a consumer to examine the ceiling fan motor 12 closely.

An endoskeleton 32 is disposed beneath the shell 14. In a preferred embodiment, the endoskeleton is cardboard that is sufficiently thick to provide structural support to the packaging 10. Many ceiling fan motors weigh more than ten pounds, and thus there is a substantial need for structural support. The endoskeleton 32 does not extend under the surfaces 22–26, thus allowing an unobstructed view of a portion of the ceiling fan motor 12. As mentioned above, it is important that there be an unobstructed view of a portion of the ceiling fan motor 12 because aesthetics are an important factor in ceiling fan selection.

Moreover, the endoskeleton 32 may bear printed messages regarding the ceiling fan motor, as well as other information which will be described with reference to the discussion of the operation of one embodiment of the invention.

Figure 3A:
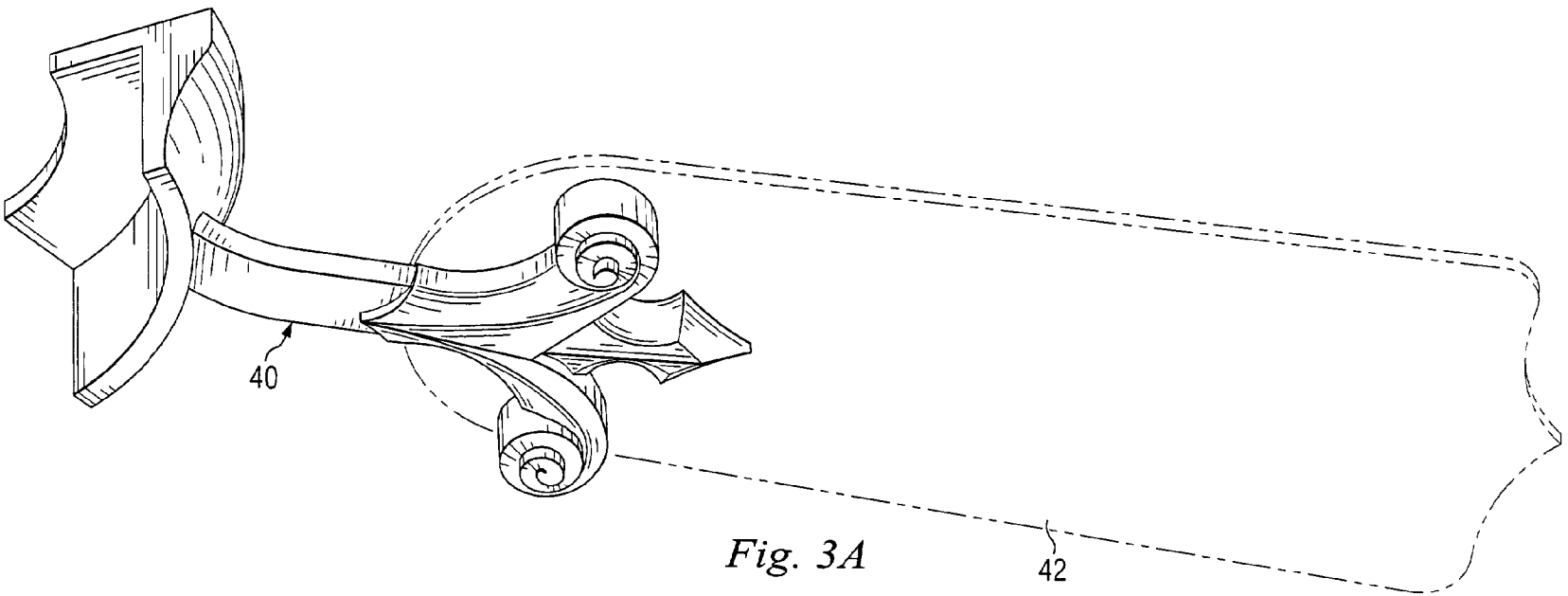
FIG. 3A is a bottom perspective view of a ceiling fan blade iron.

Referring to FIG. 3A, a blade iron 40 is adapted to be received in a conventional manner by the ceiling fan motor 12 (FIG. 1). It is understood that a ceiling fan motor is normally designed to accommodate between four and six blade irons.

The portion of the blade iron 40 distal to the ceiling fan motor (not depicted) attaches in a conventional manner to a ceiling fan blade 42. Thus, the blade iron 40 operably connects the ceiling fan blade 42 to the ceiling fan motor 12 (FIG. 1). As is well known, the ceiling fan motor 12 (FIG. 1) rotates the ceiling fan blade 42, and air is circulated in proportion to the pitch that the blade iron gives the ceiling fan blade relative to the axis of rotation.

The ceiling fan blade 42 is illustrated in phantom to indicate the important potential for aesthetic variation among ceiling fan blades. Some examples of ceiling fan blades will be discussed with reference to FIGS. 4A–C.

Figure 3B:
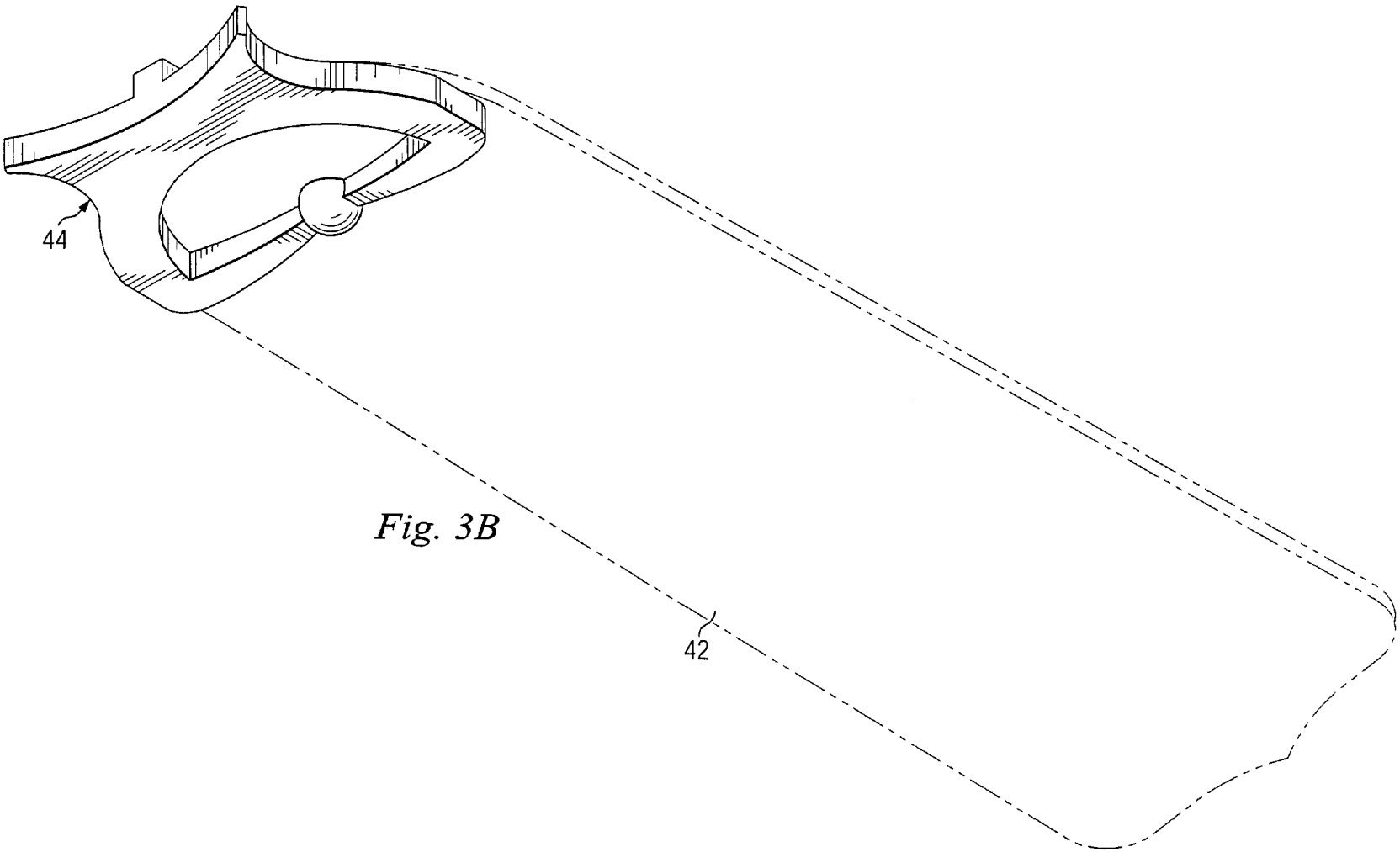
FIG. 3B is a bottom perspective view of another ceiling fan blade iron.

Referring to FIG. 3B, another decorative embodiment of a blade iron is illustrated, and given the reference numeral 44. The blade iron 44 is attached to the ceiling fan blade 42. It is understood that the blade iron 44 operates in substantially the same manner as the blade iron 40, and thus the differences are aesthetic.

Figure 3C:
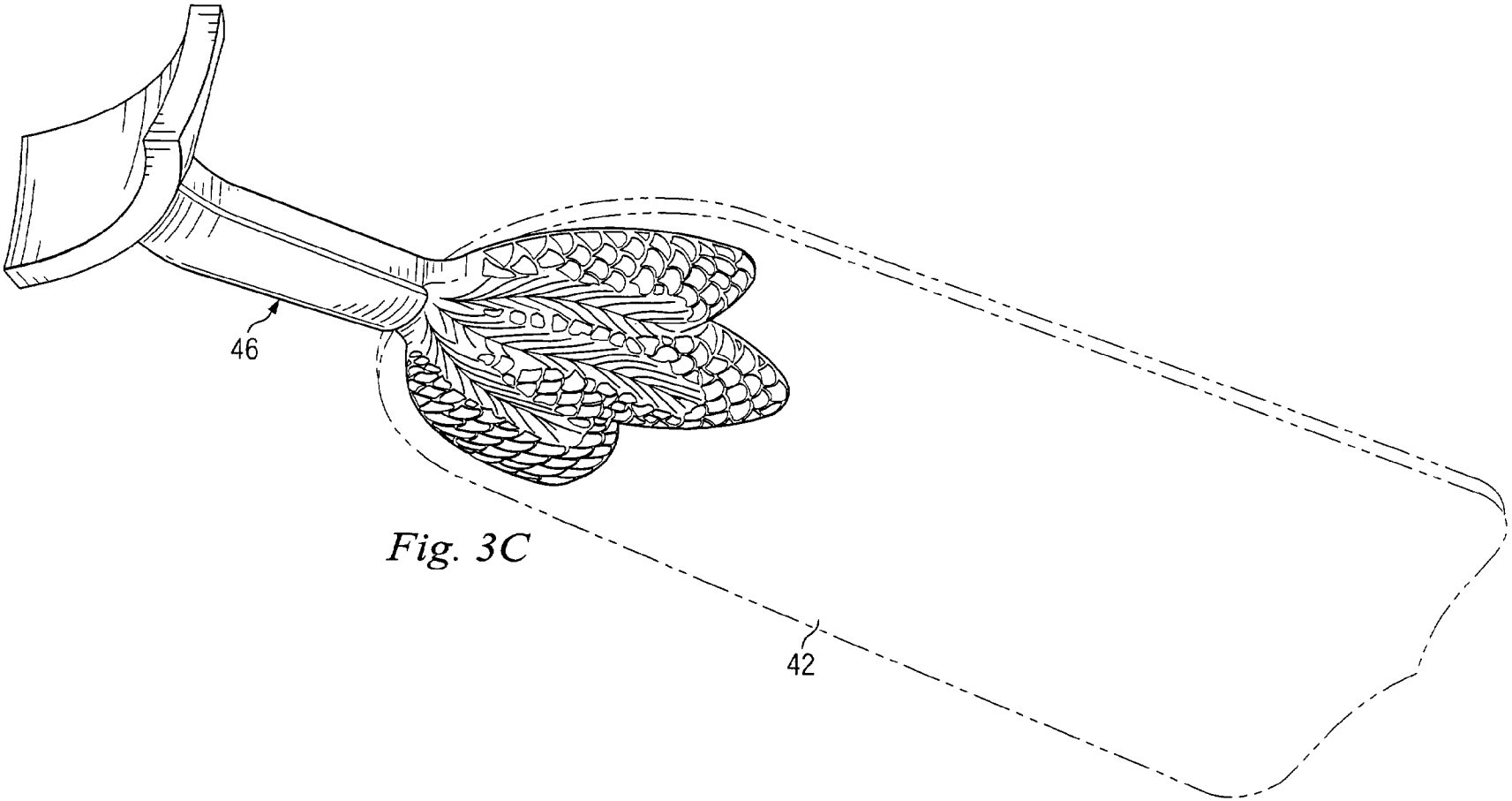
FIG. 3C is a bottom perspective view of yet another ceiling fan blade iron.

Referring to FIG. 3C, another decorative embodiment of a blade iron is illustrated, and given the reference numeral 46. The blade iron 46 is attached to the ceiling fan blade 42. It is understood that the blade iron 46 operates in substantially the same manner as the blade iron 40, and thus the differences are aesthetic.

Figure 4A:
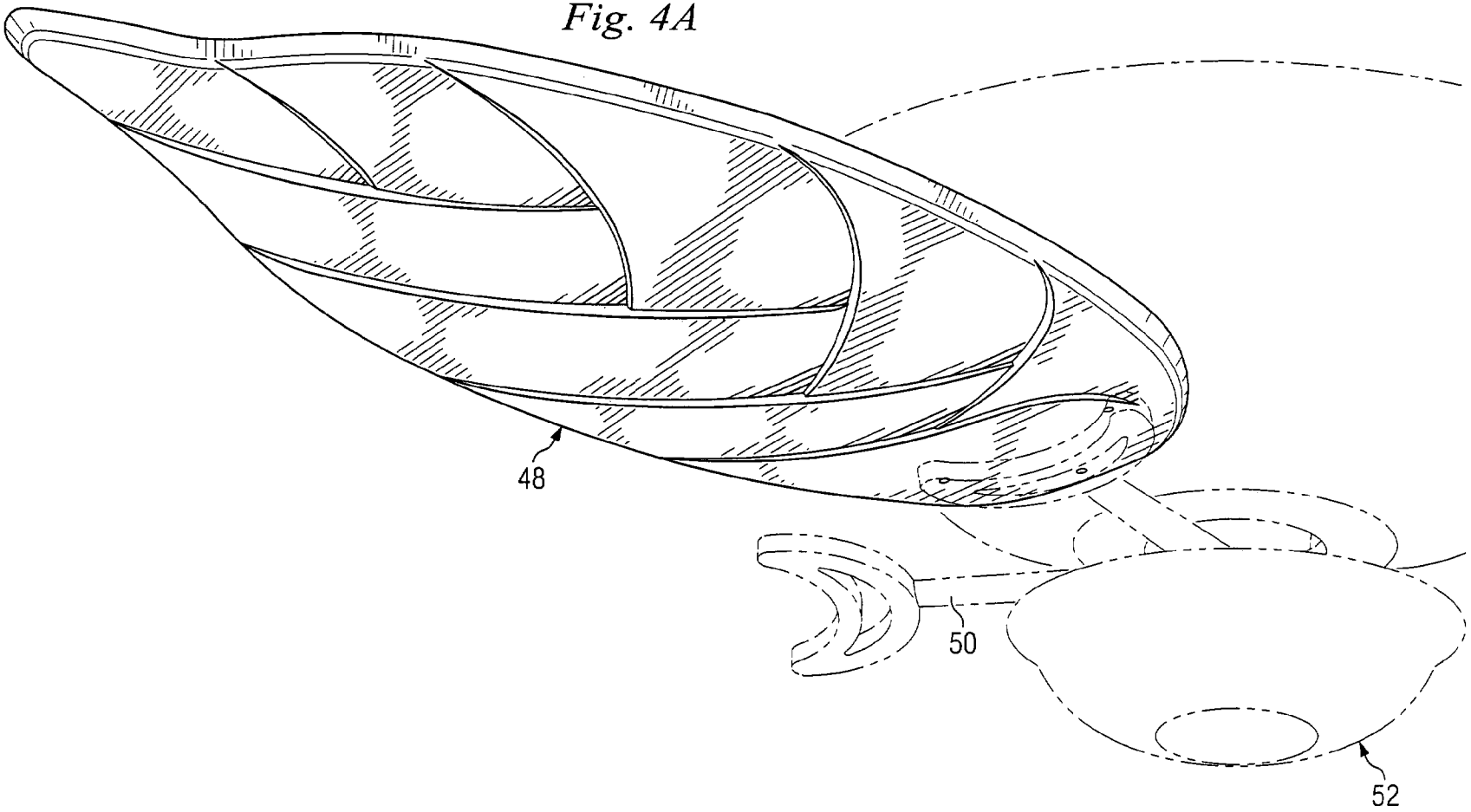
FIG. 4A is a bottom perspective view of a ceiling fan blade.

Referring to FIG. 4A, a decorative embodiment of a ceiling fan blade is illustrated, and given the reference numeral 48. The ceiling fan blade 48 is attached to a blade iron 50 in a conventional manner. The blade iron 50 is illustrated in phantom to indicate the important potential for aesthetic variation among blade irons, such as is evident from the examples of blade irons that were discussed with reference to FIGS. 3A–C. As noted above, the blade iron 50 is received in a conventional manner by a ceiling fan motor 52, also illustrated in phantom to indicate the potential for aesthetic variation.

Figure 4B:
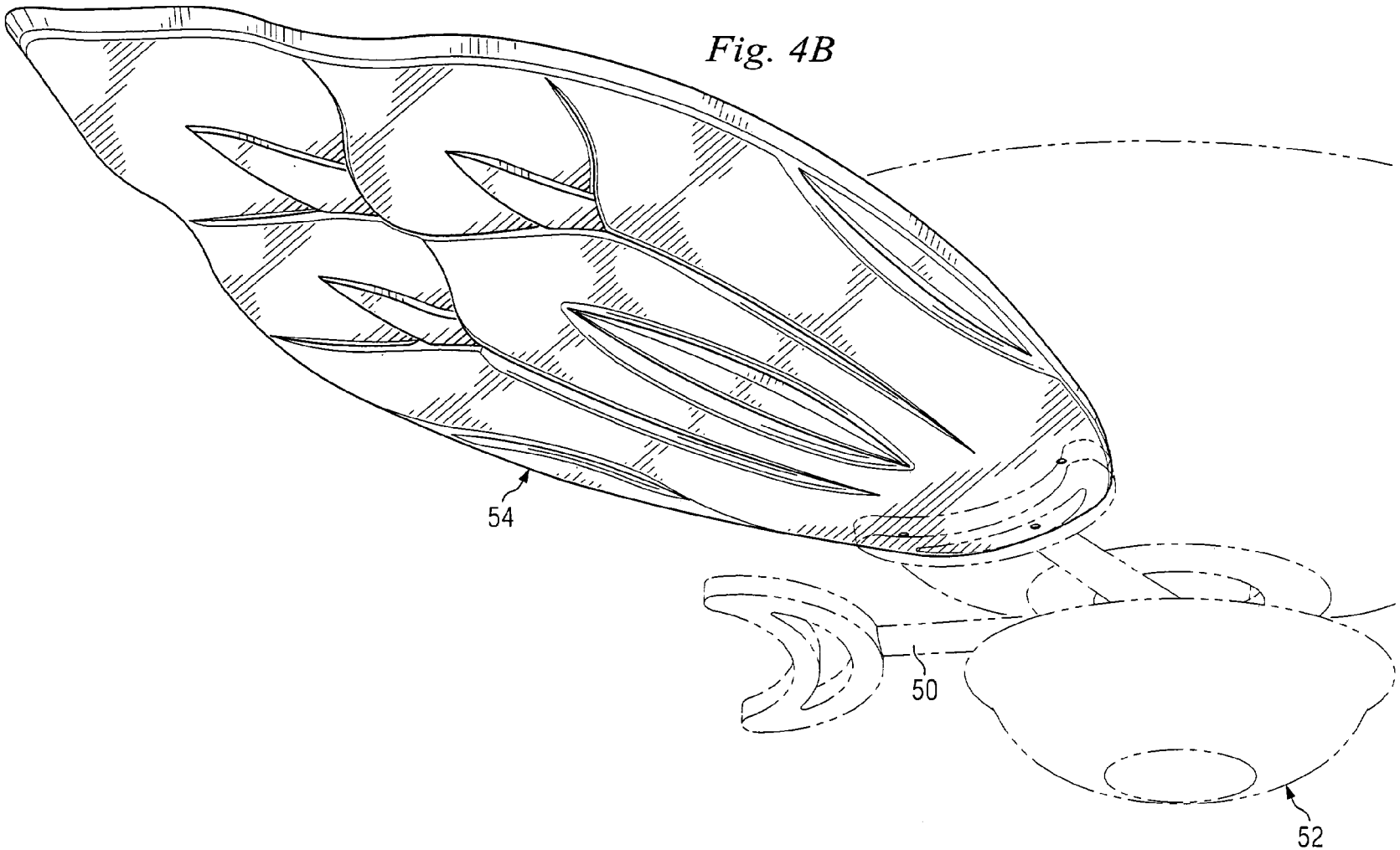
FIG. 4B is a bottom perspective view of another ceiling fan blade.

Referring to FIG. 4B, another decorative embodiment of a ceiling fan blade is illustrated, and given the reference numeral 54. It is understood that the ceiling fan blade 54 operates in substantially the same manner as the ceiling fan blade 48, and thus the differences are aesthetic.

Figure 4C:
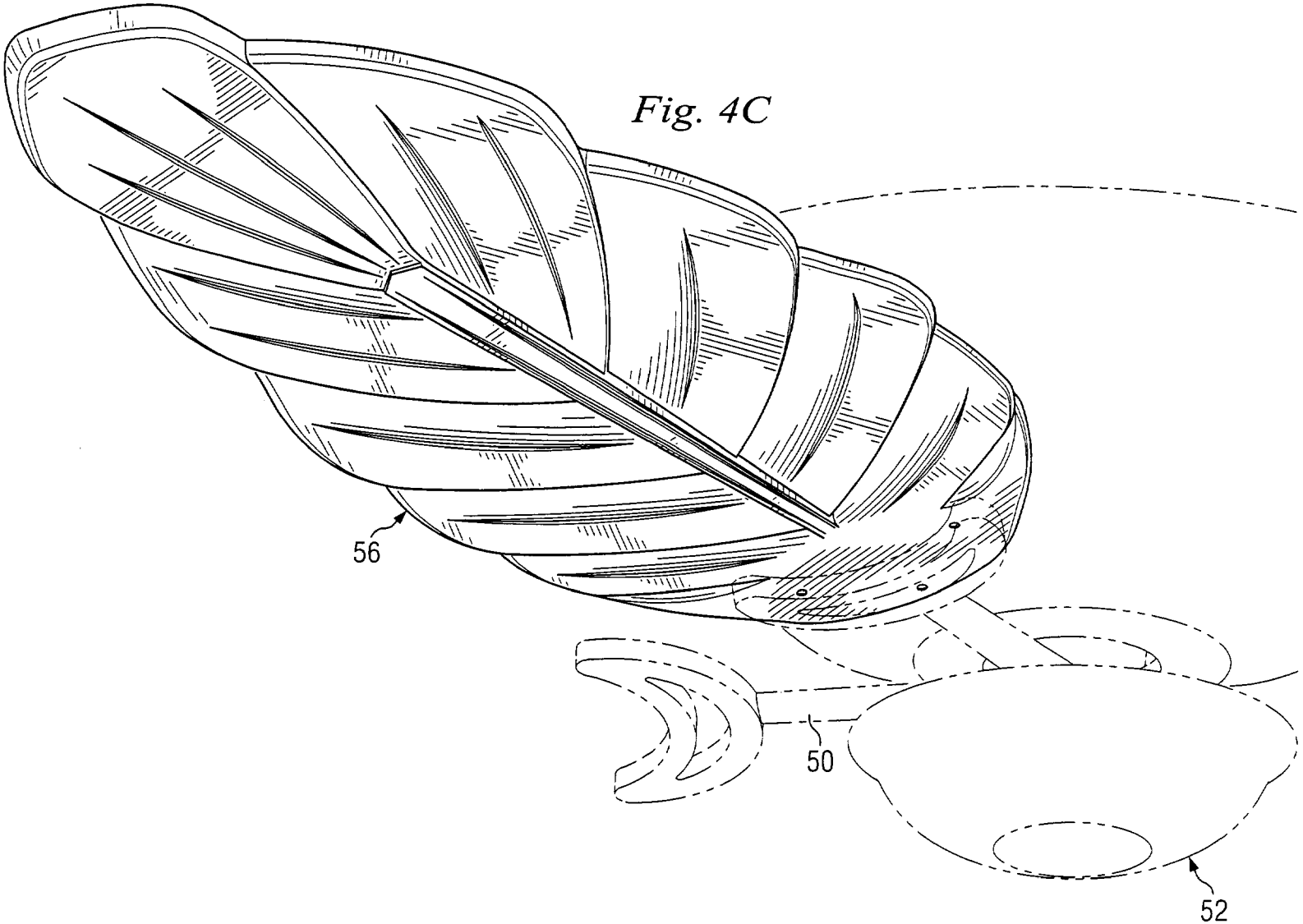
FIG. 4C is a bottom perspective view of yet another ceiling fan blade.

Referring to FIG. 4C, another decorative embodiment of a ceiling fan blade is illustrated, and given the reference numeral 56. It is understood that the ceiling fan blade 56 operates in substantially the same manner as the ceiling fan blade 48, and thus the differences are aesthetic.

Figure 5:
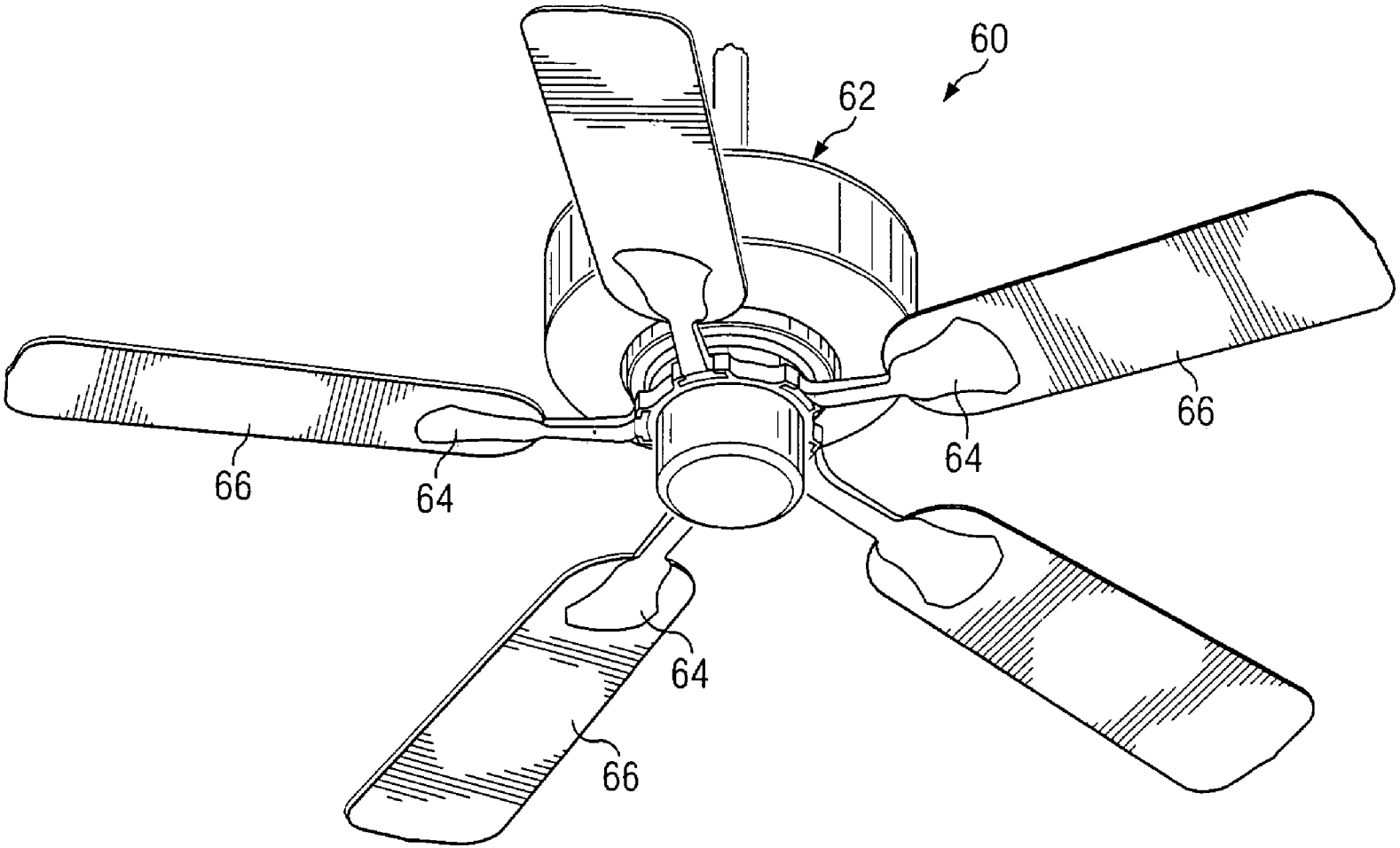
FIG. 5 is a bottom perspective view of a ceiling fan.

Referring now to FIG. 5, a ceiling fan 60 comprises a ceiling fan motor 62, a plurality of blade irons 64, and a plurality of ceiling fan blades 66. It is understood that substantially identical components are given the same reference number in this specification for the sake of simplicity.

In operation, a vendor can separately offer for sale: (i) a ceiling fan motor, such as the ceiling fan motor 62 (FIG. 5) or any other aesthetic variation of a ceiling fan motor; (ii) a plurality of blade irons, such as the blades irons 40 (FIG. 3A), 44 (FIG. 3B), 46 (FIG. 3C), or 64 (FIG. 5) or any other aesthetic variation of a blade iron; and (iii) a plurality of ceiling fan blades, such as the ceiling fan blades 48 (FIG. 4A), 54 (FIG. 4B), 56 (FIG. 4C), or 66 (FIG. 5) or any other aesthetic variation of a ceiling fan blade. This allows a consumer to build a ceiling fan, such as the ceiling fan 60 (FIG. 5), by selectively purchasing a ceiling fan motor, blade irons, and ceiling fan blades according to his or her individual taste. As aesthetics are an important factor in ceiling fan selection, providing a greater variety of aesthetic options is an important achievement.

It can be appreciated that the ceiling fan motor packaging 10 (FIGS. 1 and 2) is crucial to the success of such a venture. The ceiling fan motor packaging 10 allows a portion of the ceiling fan motor to be observed through the surfaces 22–26 (FIGS. 1–2), thus facilitating the ceiling fan motor selection. Moreover, the endoskeleton 32 provides the structural support necessary to adequately display the ceiling fan motor, while also being useful for bearing printed messages regarding the ceiling fan motor. Likewise, the endoskeleton may contain a selection of suggested pairings of the particular ceiling fan motor at issue and certain designs of blade irons and ceiling fan blades that are considered aesthetically desirable for pairing.

Although only a few exemplary embodiments of this invention have been described in detail above, those skilled in the art will readily appreciate that many other modifications are possible without materially departing from the novel teachings and advantages of the invention. Accordingly, all such modifications are intended to be included within the scope of this invention as defined in the following claims.

What is claimed is:

1. A packaging containing a ceiling fan motor, comprising:

an outer shell having a bottom portion and an upper portion, wherein the bottom portion has a planar bottom surface for supporting the packaging in a free-standing position and the upper portion has a non-planar, transparent front portion for covering a portion of the ceiling fan motor, and an internal endoskeleton disposed between the outer shell and at least a portion of the ceiling fan motor for providing structural support for the packaging, wherein the endoskeleton has an opening formed therein for enabling viewing of a portion of the ceiling fan motor.

2. The packaging of claim 1 wherein the endoskeleton has a generally planar portion bearing printed messages regarding the ceiling fan motor.

3. The packaging of claim 1 wherein the ceiling fan motor includes a motor housing and a switch housing, and the front portion includes a first portion for covering the motor housing and a second portion for covering the switch housing.

4. The packaging of claim 3 wherein the second portion extends outward from the first portion.

5. A method for selling a ceiling fan including a ceiling fan motor, a set of ceiling fan blades, and a set of blade irons for attaching the blades to the motor, comprising the steps of:

providing the motor in a first packaging, the first packaging comprising a shell at least a portion of which is transparent, and an endoskeleton disposed beneath the shell, providing a plurality of different sets of irons each aesthetically and functionally compatible with the motor wherein each set of irons is contained within its own packaging separate from the first packaging, and providing a plurality of different sets of blades each aesthetically and functionally compatible with the motor wherein each set of blades is contained within its own packaging separate from the first packaging.

6. The method of claim 5 wherein the first packaging includes a transparent portion for enabling viewing of portions of the motor within the packaging.

7. The method of claim 5 wherein the first packaging comprises:

an outer shell having a bottom portion and an upper portion, wherein the bottom portion has a planar bottom surface for supporting the packaging in a free-standing position and the upper portion has a non-planar, transparent front portion for covering a portion of the motor, and an internal endoskeleton disposed between the outer shell and at least a portion of the motor for providing structural support for the packaging, wherein the endoskeleton has an opening formed therein for enabling viewing of a portion of the motor.

8. The method of claim 5 further comprising the step of selecting one set of irons and one set of blades to purchase with the motor.

* * * * *